United States Patent [19]

Boudreau et al.

[11] 4,171,565

[45] Oct. 23, 1979

[54] CONTACT INSERTION AND REMOVAL TOOL

[75] Inventors: Jon P. Boudreau, Gloucester; Marvin A. Biren, Chestnut Hill; Herald S. Sulahian, Arlington; Robert J. Maselek, Framingham, all of Mass.

[73] Assignee: The Charles Stark Draper Laboratory, Inc., Cambridge, Mass.

[21] Appl. No.: 918,721

[22] Filed: Jun. 26, 1978

[51] Int. Cl.[2] ..... H01R 43/00

[52] U.S. Cl. ..... 29/739; 29/758; 29/764; 145/61 EA; 145/61 G

[58] Field of Search ..... 29/739, 758, 764; 81/177 R, 3 R; 145/50 B, 61 G, 61 E, 61 EA

[56] References Cited

U.S. PATENT DOCUMENTS

| | | | |
|---|---|---|---|
| 814,318 | 3/1906 | Peck | 145/61 G |
| 1,816,359 | 7/1931 | Carlin | 145/61 G |
| 3,074,155 | 1/1963 | Cootes et al. | 29/739 |
| 3,621,555 | 11/1971 | Cowmeadow | 29/764 X |

*Primary Examiner*—Carl E. Hall

*Attorney, Agent, or Firm*—Joseph S. Iandiorio

[57] ABSTRACT

A contact insertion and removal tool including a removable, replaceable probe made of a hollow tubular member with a slot extending longitudinally from the tip at least part way to the upper end of the tubular member, the tubular member having proximate its tip a reduced outer diameter and enlarged inner diameter sized appropriately for the contact to be inserted and removed; a handle member, independent of the probe, having a passage for receiving the upper end of the tubular member; and means for rotatably securing the probe and handle.

1 Claim, 9 Drawing Figures

CONTACT INSERTION AND REMOVAL TOOL

FIELD OF INVENTION

This invention relates to a tool for inserting and removing contacts in electrical connectors, and more particularly to such a tool having a handle and an independent removable and replaceable probe made of a tubular member.

BACKGROUND OF INVENTION

Conventional tools for inserting and removal of contacts in electrical connectors are of two general types: a rigid tool and a tweezer type tool. The rigid tool is formed of a handle and probe shaft which are fixed together as one piece. The shaft is formed of bar stock with the tip drilled to form a central cylindrical recess to receive the upper end of the contact, and a groove extends from the tip toward the handle to accommodate the wire extending from the contact. In use the tool is slipped over the contact, then used to push the contact into a hole in the connector. The tool spreads spring tines as it enters the hole, then allows the tines to close and hold the contact as the tool is withdrawn. This tool has a number of shortcomings. It is expensive to manufacture because of the machining operations required to make it. The solid rod stock from which it is made is brittle and when too much force is applied to the tool, as is often the case, the tip may break off inside the connector, damaging and/or making the connector useless. Damage can also result if this tool is rotated while inserted in the connector, as the groove can catch on the spring tines and bend or break them. Any such damage to the connector is extremely serious as they are nearly never repaired and their cost may be $400 or more. The tweezer tool is formed of two semi-cylindrical parts which close about the contact. This tends to be even more costly to manufacture than the rigid tool. In addition, it is larger and bulkier and there is the tendency to squeeze the tool too tightly, causing the semi-cylindrical parts that are inside the connector to open and thereby damage the connector.

SUMMARY OF INVENTION

It is therefore an object of this invention to provide an improved, simplified tool for inserting and removing contacts which is easier and less expensive to manufacture.

It is a further object of this invention to provide such a tool which upon application of excessive lateral force will bend and not break off in the connector.

It is a further object of this invention to provide such a tool whose shaft or probe is independent of the handle and is easily removable and replaceable.

It is a further object of this invention to provide such a tool in which the handle is rotatable relative to the probe to prevent rotational force being applied to the probe in the connector.

The invention features a contact insertion and removal tool which includes a removable, replaceable probe made of a hollow tubular member. The tubular member has a slot extending longitudinally from the tip at least part of the way to the upper end of the tubular member. The tubular member has proximate its tip a reduced outer diameter and an enlarged inner diameter sized appropriately for the contact to be inserted and removed. A handle member independent of the probe has a passage for receiving the upper end of the tubular member. There are means for releasably, rotatably securing together the probe and handle.

Preferably, the probe includes an enlarged portion at its upper end and the passage in the handle includes a wide section for receiving the tubular member and the enlarged portion, and a narrow section for receiving only the tubular member and blocking further longitudinal movement of the tubular member through the handle passage. The enlarged section of the passage may include threads which engage with a threaded plug constituting means for rotatably securing the probe and handle. The plug may have a bearing surface at one end for pressing on the upper end of the tubular member to secure it longitudinally and yet enable it to rotate relative to the handle. The tubing from which the tubular member is formed is preferably cylindrical and of a ductile material such as #304 stainless steel.

DISCLOSURE OF PREFERRED EMBODIMENT

Other objects, features and advantages will occur from the following description of a preferred embodiment and the accompanying drawings, in which.

The invention may be accomplished with a contact insertion and removal tool which includes a probe made of a hollow tubular member. The member is made out of tubing rather than solid rod stock, preferably cylindrical, and the tubing is made of a material which is at least less brittle than typical solid rod stock. The probe has a slot extending from the tip longitudinally up at least part way to the upper end of the tubular member to accommodate wire which extends from the end of the contact to be gripped. The tubular member has at its tip a reduced outer diameter appropriately sized for ease of insertion into the connector hole and an inner diameter appropriately sized for easily receiving and helping to center a contact in the tool. The handle and the probe are independent, and the probe is removable and replaceable in the handle, so that at any time a probe is bent or damaged it alone may be replaced without having to replace the entire tool. The handle has a passage for receiving the upper end of the tubular member and some means for releasably securing together the probe and handle while simultaneously permitting the probe to rotate about its longitudinal axis in the handle.

Typically, the probe includes an enlarged portion at its upper end which may be formed, for example, by a band or sphere attached to the upper end. The passage through the handle includes a wide section which receives the tubular member and the enlarged spherical portion or ball, and a narrow section, which receives the tubular member only and blocks further longitudinal movement of the tubular member through the handle passage during assembly. The enlarged section of the passage may include threads and the means for rotatably securing the probe and handle may include a threaded plug which engages with those threads and has a bearing surface at one end which presses on the ball or band at the upper end of the tubular member to secure it longitudinally against movement in the handle and yet enable it to rotate relative to the handle. The tubular member may be formed of #304 stainless steel.

Figure 1:
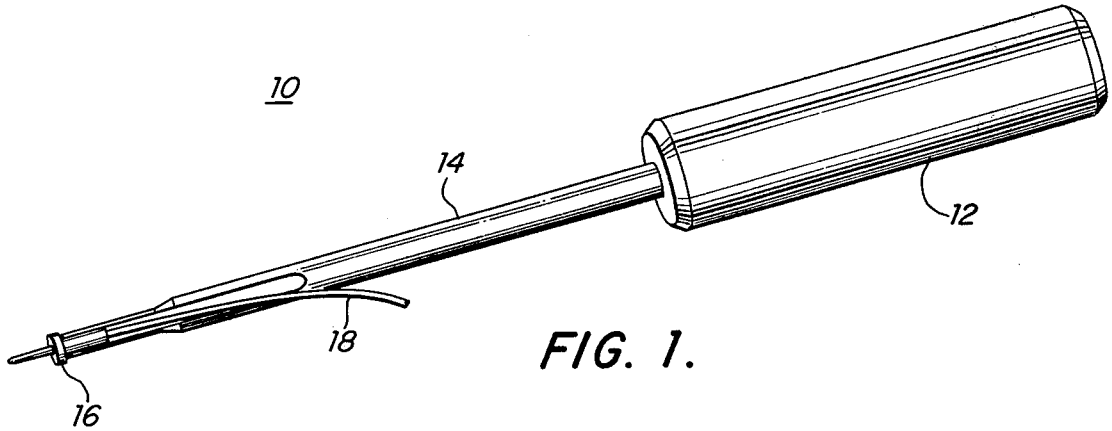
FIG. 1 is an axonometric view of a tool according to this invention holding a contact for insertion.
Figure 2:
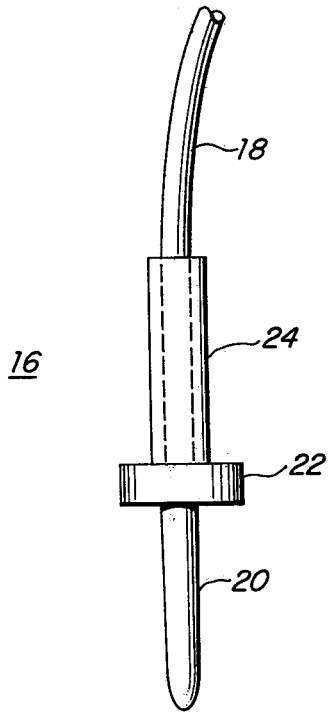
FIG. 2 is an enlarged side elevational view of the contact in FIG. 1.

There is shown in FIG. 1 a contact insertion and removal tool 10, which includes a handle 12 and a probe 14 for gripping a contact 16 connected to a wire 18. Contact 16, FIG. 2, includes a pin 20 at one end joined by means of shoulder 22 with a hollow cylindrical portion 24 at the other end which receives and is crimped on wire 18. Contact 16 is generally known as a male pin contact. A female pin contact is similarly constructed but includes instead of pin 20 a hollow cylindrical receptacle which receives pin 20. This tool performs equally well with both types of contacts.

Figure 3:
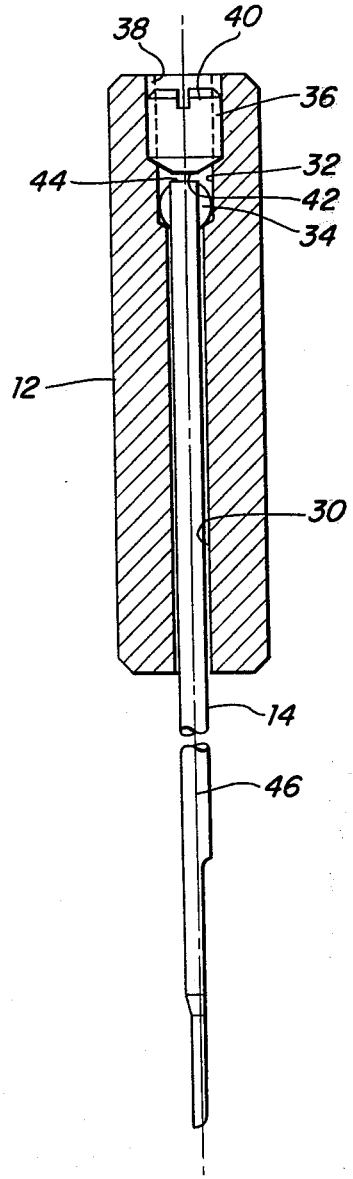
FIG. 3 is a side elevational view with portions in cross section of the tool of FIG. 1.
Figure 4:
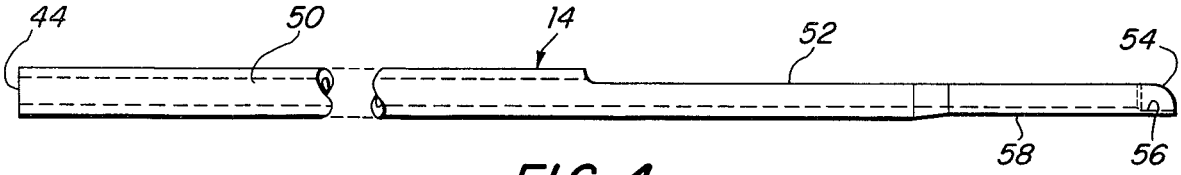
FIG. 4 is a side elevational view of the probe.
Figure 5:
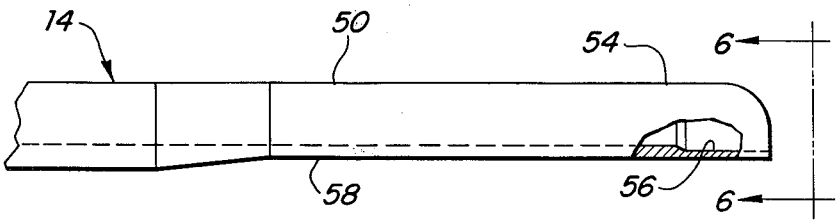
FIG. 5 is an enlarged view of the tip of the probe in FIG. 4.
Figure 7:
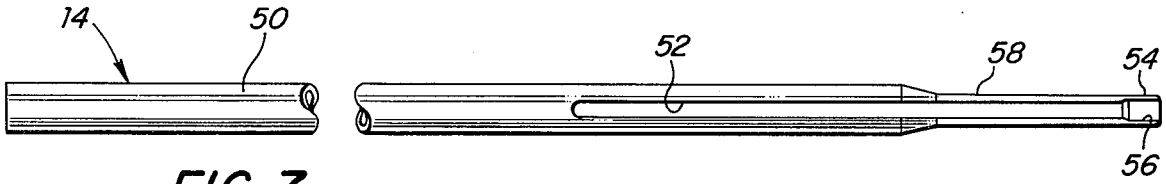
FIG. 7 is a top elevational view of the probe of FIG. 4 rotated 90°.
Figure 6:
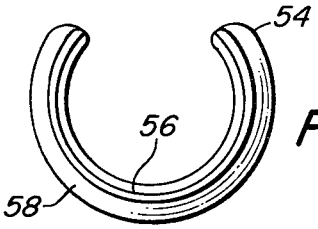
FIG. 6 is an enlarged view taken along lines 6—6 of FIG. 5.

Handle 12 may be formed of nylon or similar low-friction material with a small bore 30, FIG. 3, at its lower end and an enlarged bore 32 at its upper end for accommodating the enlarged portion of probe 14 where it is joined with sphere or ball 34. The upper end of passage 32 includes threads 38 which engage with similar threads 36 on plug 40, which is screwed into passage 32 so that its bearing surface 42 bears on the upper end 44 of probe 14 at ball 34 and prevents probe 14 from moving longitudinally in passage 30, but permits it to rotate about its own axis 46 coincident with that of handle 12. With this facility, it is impossible for the user to twist or turn probe 14 by applying a twisting or rotating motion to handle 12, since the handle will only be caused to rotate independently of probe 14 without imparting its own rotary motion to probe 14. Probe 14 is formed of a hollow tube 50, FIGS. 4–7, which has a groove 52 extending from its tip 54 at least part way toward its upper end 44. Slot 52 is provided to accommodate wire 18 that extends from contact 16 while the tool grips the upper portion 24 of contact 16.

At tip 54, the internal diameter is enlarged at 56 in order to facilitate the lodging of pin 16 in probe 14. Also in this area the outer portion is reduced, 58, in order to facilitate the insertion of probe 14 in the holes in the connector.

Figure 8:
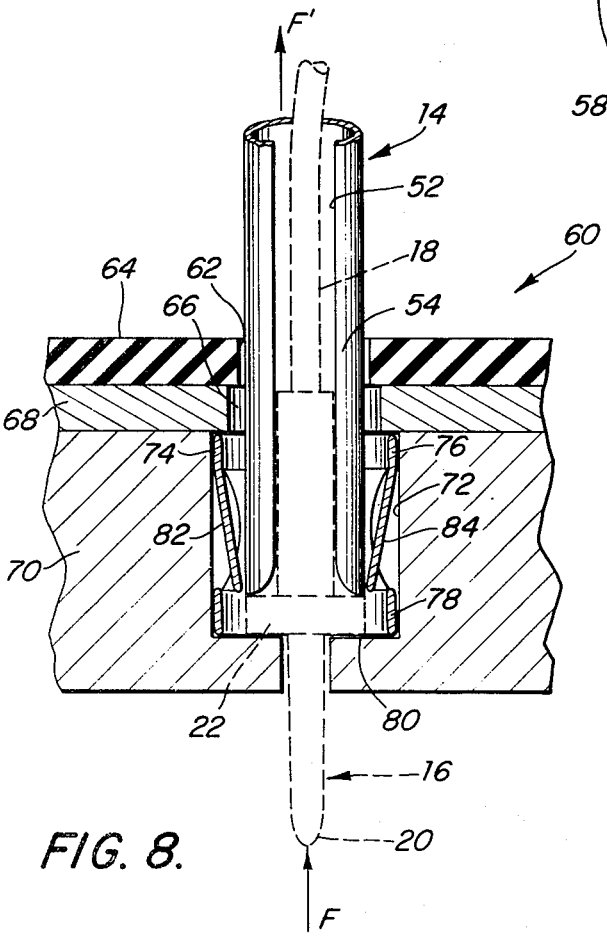
FIG. 8 is an enlarged view of a portion of an electrical connector showing insertion of contact using the tool according to this invention.
Figure 9:
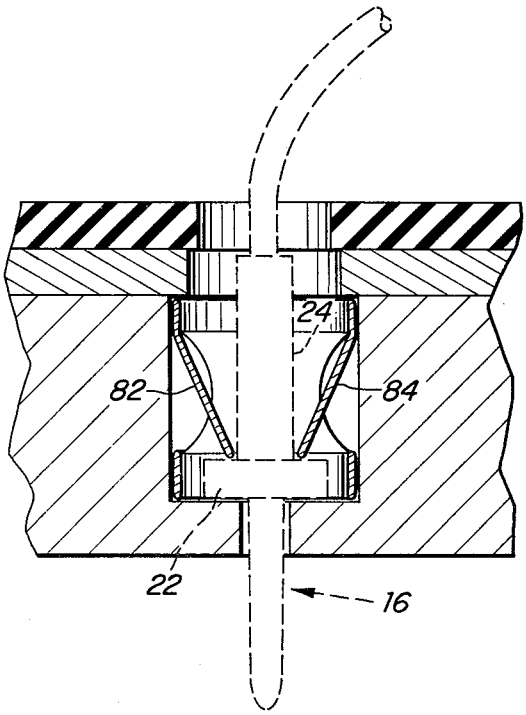
FIG. 9 is a view similar to FIG. 8 after the contact has been installed and the tool removed.

In operation, with contact 16 gripped in the tip 54 FIG. 8, and wire 18 from contact 16 accommodated by groove 52, tip 54 and contact 16 are inserted into the connector 60 such as MIL-SPEC-27493, by pushing pin 20 through hole 62 in resilient pad 64 and then through hole 66 in insert block cap 68 on insert block 70. Insert block 70 includes an enlarged hole 72 having a generally cylindrical spring member 74 whose upper end 76 is retained against insert block cap 68 and lower end 78 is retained by the bottom 80 of hole 72. Inwardly biased tines 82 and 84, spread apart by shoulder 22 and tip 54 of probe 10, retract inwardly as tip 54 of probe 14 is withdrawn so that in the final position tines 82 and 84, FIG. 9, rest against the upper end of shoulder 22 and against cylinder 24, preventing withdrawal of contact 16. Tool 10 may be used as a removal tool by reinserting it in the position shown in FIG. 9 so that it once again creates the condition as shown in FIG. 8. Then a gentle force F, FIG. 8, applied to the tip of pin 20, accommodated by a similar withdrawal force F′ on probe 14 and the contact via wire 18, permits contact 16 to be withdrawn while tines 82 and 84 are spread, thereby permitting shoulder 22 to clear tines 82 and 84 and move upwardly and outwardly of holes 66 and 62.

Other embodiments will occur to those skilled in the art and are within the following claims.

What is claimed is:

1. A contact insertion and removal tool comprising:

a removable, replaceable probe made of a hollow ductile tubular member, said tubular member including a slot extending longitudinally from the tip at least part way to the upper end of the tubular member, said tip of said tubular member including a reduced outer diameter for reception in a connector and an enlarged inner diameter for receiving a pin; said tubular member further including an enlarged portion proximate its other end opposite said tip;

a handle member independent of said probe, having a first passage for receiving the upper end of said tubular member and said enlarged portion and a second, smaller passage for receiving only said tubular member and blocking said enlarged portion; said first passage including a threaded portion; and a threaded member having a bearing surface at one end for bearing on the upper end of said tubular member to secure it longitudinally and yet enable it to rotate relative to said handle member.

* * * * *